US006603084B2

(12) United States Patent
Ogden

(10) Patent No.: US 6,603,084 B2
(45) Date of Patent: Aug. 5, 2003

(54) GRAVITY RESPONSIVE ATTITUDE SWITCH

(75) Inventor: Everett Ogden, Ponte Vedra Beach, FL (US)

(73) Assignee: Par Technology, Inc., Jacksonville, FL (US)

( * ) Notice: Subject to any disclaimer, the term of this patent is extended or adjusted under 35 U.S.C. 154(b) by 0 days.

(21) Appl. No.: 10/213,989

(22) Filed: Aug. 7, 2002

(65) Prior Publication Data

US 2003/0024797 A1 Feb. 6, 2003

Related U.S. Application Data

(63) Continuation-in-part of application No. 09/716,500, filed on Nov. 20, 2000, now abandoned.

(51) Int. Cl.[7] ..... H01H 35/14

(52) U.S. Cl. ..... 200/61.47; 200/61.52; 200/182

(58) Field of Search ..... 200/61.47, 61.46, 200/61.45, 61.52, 215, 220, 153 A, 182, 185, 193, 194, 304, 305

(56) References Cited

U.S. PATENT DOCUMENTS 2,251,011 A * 7/1941 Bear ..... 200/222
2,265,681 A * 12/1941 Bear et al. ..... 200/226
2,977,559 A * 3/1961 Rosenberg et al. ..... 338/44
3,259,900 A * 7/1966 Lord ..... 343/705
3,683,136 A * 8/1972 van den Bosch et al. 200/61.47
4,493,155 A * 1/1985 Comeau et al. ..... 33/366.26
4,521,974 A * 6/1985 Neis et al. ..... 33/379
4,761,708 A * 8/1988 Ficken ..... 361/212
RE32,998 E * 7/1989 Davis ..... 440/75

* cited by examiner

*Primary Examiner*—Lincoln Donovan
*Assistant Examiner*—K. Lee
(74) *Attorney, Agent, or Firm*—Thomas C. Saitta

(57) ABSTRACT

A gravity responsive attitude switch containing electrical contacts separated by a gap, the switch containing a bead liquid and a carrier liquid, the two liquids being immiscible and having different electric resistivity values, where the liquid bead may be disposed between the contacts by properly positioning the switch. The contacts are connected in an electronic circuit which senses the difference in resistivity dependent on whether the bead liquid or the carrier liquid is bridging the gap between the contacts, which in turn determines whether an operative electric circuit is opened or closed.

20 Claims, 4 Drawing Sheets

GRAVITY RESPONSIVE ATTITUDE SWITCH

This application is a continuation-in-part application of U.S. patent application Ser. No. 09/716,500, filed Nov. 20, 2000, now abandoned.

BACKGROUND OF THE INVENTION

This invention relates generally to the field of gravity responsive or attitudinal switches, where the switch is operated by movement of the switch relative to true vertical, such that the position or attitude of the switch determines its operational status, for example, whether it is on/off or open/closed. More particularly, the invention relates to such switches which include a liquid element within a housing, where the position of the liquid element determines the operational status of the switch, usually in conjunction with the liquid element either completing or not completing an electrical circuit between a pair of contacts.

Gravity responsive or attitudinal switches, often referred to a tilt switches or mercury switches, are well known. A typical switch comprises a sealed chamber retaining a ball or bead of liquid mercury, a highly electrically conductive material which remains liquid at temperatures above −39 degrees C. The liquid mercury bead is a gravity responsive element, in that it will always occupy the lowermost position within the chamber as the chamber is moved, rotated, tilted, etc. A pair of contacts or leads, typically metal wires, are inserted through the body of the switch so that ends of the contacts are disposed within the chamber at a place where the liquid mercury bead can touch both contacts, with the contacts separated by a gap which is smaller than the general diameter of the liquid mercury bead. The contacts are part of a powered electrical circuit which is to be controlled by the switch. When the attitude of the switch is such that the mercury connects the two contact ends, a circuit is completed and the switch is in the on or closed status. When the attitude of the switch is such that the mercury does not bridge the gap between the two contact ends, the circuit is not completed and the switch is in the off or open status.

Although liquid mercury is an excellent material in terms of its ability to remain cohesive, i.e., to remain in the shape of a bead rather than spreading onto a surface, and in its ability to conduct electricity, it is a highly toxic material and extremely hazardous if improperly released into the environment. Misuse of mercury or its vapors can cause animal and human deaths. For this reason, it is highly desirable that gravity responsive switches be developed which do not rely on mercury.

It is an object of this invention to provide a gravity responsive or attitude switch which is capable of actuating an electric circuit, and thus in turn capable of controlling any operational function, mechanical or electronic, which does not require the use of highly conductive liquids, such as liquid mercury, as the gravity responsive element. It is a further object of this invention to provide such a switch where the gravity responsive member is a first or bead liquid which is immiscible in a second or carrier liquid, and where the surface tension of the bead liquid is such that the bead liquid retains a bead or ball-like shape within the carrier liquid, and further where the weight, density or specific gravity of the bead liquid is greater than that of the carrier liquid, so that the bead liquid will reside at the lowermost position relative to the carrier liquid, i.e., such that the bead liquid will sink within the carrier liquid. It is a further object to provide such a switch where the bead liquid gravity responsive member and the carrier liquid have differing electrical resistivity values. It is a further object to provide such a switch having at least a pair of contacts separated by a gap and disposed so as to contact the bead liquid, the carrier liquid, or both, dependent on the alignment, orientation or positioning of the switch. It is a further object to provide such a switch where the change in electrical, resistivity of the circuit containing the contacts is sensed and measured, such that the difference in resistivity sensed when the bead liquid member connects the gap between the contacts relative to the resistivity when the carrier liquid is in contact with the contacts determines the status of the switch and is used to actuate or de-actuate an operational electrical circuit.

SUMMARY OF THE INVENTION

The invention is a gravity responsive attitudinal switch used to control an operational electrical circuit, where the operative condition or status of the switch is dependent on its orientation relative to true vertical, such that in a certain position or positions the switch is "on" or creates a closed circuit in the operational circuit, while in another position or positions the switch is "off" or creates an open circuit in the operational circuit. In general, the switch comprises a sealed housing defining an internal walled chamber, with any number of plural electrical contacts being disposed through or within the housing so that the contact ends extend to or into the chamber. The contacts may be formed as discrete members or member pairs or as continuous single or paired tracks which are exposed on the surface of the chamber or suspended within the interior of the chamber, and the chamber itself may be formed with a conductive wall to define a contact. Disposed within the chamber is a first or bead liquid and a second, or carrier liquid, where the two liquids have different electrical resistivity values. The bead liquid is immiscible in the carrier liquid and its surface tension is such that it preferably forms a bead or ball-like shape within the carrier liquid. The bead liquid is heavier than the carrier liquid, such that the bead liquid will reside at the bottom of the carrier liquid and at the lowermost portion of the chamber. The position of the contacts and the size of the bead liquid is such that the bead liquid is able to bridge the gap between contacts. The contacts are part of an electrical or electronic sensing circuit having means to sense the difference in resistivity of the bead liquid versus the resistivity of the carrier liquid, such that the operative status of the switch is determined by the value of the resistance detected in the sensing circuit.

DETAILED DESCRIPTION OF THE INVENTION

With reference to the drawings, the invention will now be described in detail with regard for the best mode and the preferred embodiments. In general, the invention is a gravity responsive attitude switch which actuates an operative electrical circuit by creating an open or closed circuit in the operative circuit dependent on the relative position or attitude of the switch to true vertical. The switch has an operative or "on" status where the switch creates a closed circuit such that electricity flows through the operative electrical circuit and a non-operative or "off" status where the switch creates an open circuit such that electricity does not flow through the operative electrical circuit. The switch comprises a means to sense or measure the resistance encountered by a sensing circuit comprising a pair of contacts, such that the operative or non-operative status of the switch is determined by the resistance value as sensed dependent on the orientation or attitude of the switch.

Figure 8:
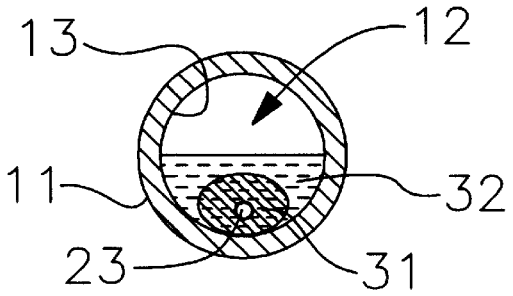
FIG. 8 is a transverse cross-sectional view of an alternative embodiment for the switch of FIG. 3, where the sensing pathway is formed by the combination of a single suspended wire within the chamber and an electrically conductive housing.

The physical configuration or shape of the switch 10 may vary. As shown in FIGS. 1 through 9, the switch 10 comprises a housing 11 which defines an internal chamber 12 having a wall 13. In FIGS. 1 through 7 and 9, the housing 11 is formed of an insulating material, such as plastic or glass, and most preferably is made of PTFE due its non-wetting properties. In FIG. 8 the housing 11 is formed of a conductive metal. Electrical contact members 20 are disposed through the housing 11 to chamber 12 such that a gap exists between the individual contact members 20, with the contact members 20 being connected to a powered electrical circuit in standard manner. Preferably the chamber 12 is circular in transverse cross-section.

Disposed within the chamber 12 is a first or bead liquid 31 and a second or carrier liquid 32, where the bead liquid 31 has an electrical resistivity or resistance value different from that of the carrier liquid 32, and where the bead liquid 31 is preferably present in an equal or lesser amount than the carrier liquid 32. The two liquids 31 and 32 may be relatively conductive liquids, relatively non-conductive liquids, or a combination of the two. The bead liquid 31 is immiscible relative to the carrier liquid 32, such that the two liquids 31 and 32 remain distinct in the chamber 12. Preferably the bead liquid 31 is heavier or denser than the carrier liquid 32, such that bead liquid 31 is a gravity responsive member and sinks within carrier liquid 32 so as to always occupy the lowermost position relative to the carrier liquid 32 and the lowermost position in the chamber 12. Also preferably the surface tension characteristic of the bead liquid 31 is such that it retains a bead or ball-like shape relative to the carrier liquid 32, as shown in the drawings, rather than flattening out. It is also preferred that both the bead and carrier liquids 31 and 32 be relatively viscous to create a damping effect, such that they are less susceptible to increased dispersion in the event that the switch 10 is shaken or bounced. Suitable liquids for bead liquid 31 may for example include a liquid chosen from the group including ethylene glycol, propylene glycol, salt water or silver nitrate. Suitable liquids for the carrier liquid 32 may for example include a liquid chosen from the group including silicone oil, benzene or toluene.

Figure 1:
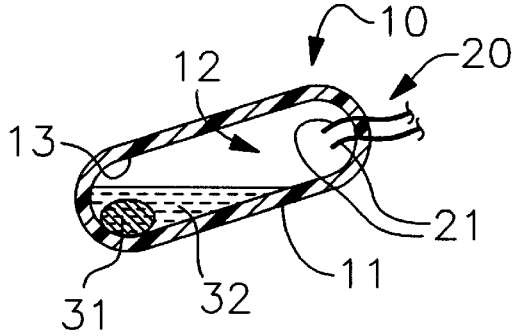
FIG. 1 is a longitudinal cross-sectional view of the invention structured as a tilt switch shown in the non-operative status.
Figure 2:
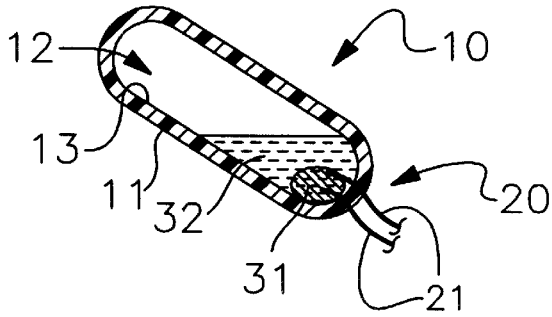
FIG. 2 is a longitudinal cross-sectional view of the switch of FIG. 1 shown in the operative status.
Figure 6:
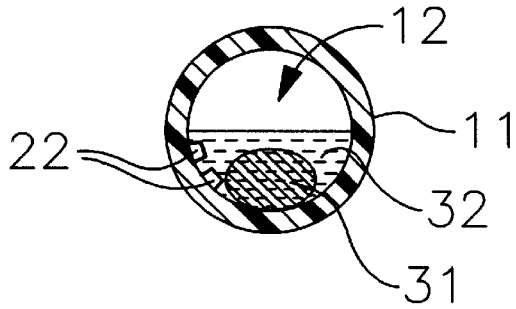
FIG. 6 is a view similar to FIG. 5, showing the switch in the non-operative status.
Figure 7:
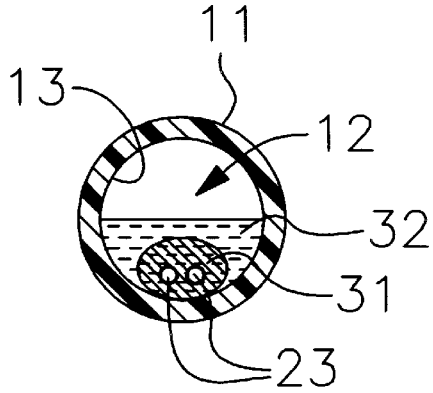
FIG. 7 is a transverse cross-sectional view of an alternative embodiment for the switch of FIG. 3, where the sensing pathway is formed by a pair of wires suspended or disposed within the chamber.

The contact members 20 may be comprised of pins or leads 21 which extend into the chamber 20, as shown in FIGS. 1 through 4. In FIGS. 1 and 2, the contact members 20 are a pair of pins 21 which are positioned at one end of a chamber 20 formed in the shape of a linear tube. The pins 21 are separated to define a gap. In FIG. 2 the switch 10 is tilted so that the contact members 20 are disposed in the now lowermost section of the chamber 12. The gravity responsive bead liquid 31 also occupies this lowermost position, thereby connecting the two contact members 20 in circuit such that the resistance encountered by electricity flowing between the two contact members 20 is determined by the resistivity value of the bead liquid 31. This first operative condition or status for the switch 10 will typically comprise the "on" status in practical application, and therefore such condition will be defined herein as the operative status, in that the position or pathway for the contact members 20 is the predetermined or defined attitude or orientation for the switch 10 as shown, and the switch 10 will allow electricity to flow through the operative circuit, i.e., the switch 10 and operational circuit is "on". In the second or non-operative status, the bead liquid 31 is disposed away from the contact members 20 due to the attitude of the housing 11 and current flows through either the combination of the bead liquid 31 and the carrier liquid 32, through the carrier liquid 32 alone, as shown in FIG. 6, or through neither of the liquids 31 or 32, as shown in FIG. 1. In each particular case, the resistance encountered by the current passing through the contact members 20 will differ in a measurable manner from the resistivity value of the bead liquid 31. In this second or non-operative status, the switch 10 is "off" and electricity does not flow through the operative circuit. Alternatively, the switch 10 can be constructed such that it is in the non-operative or "off" status when the bead liquid 31 bridges the gap of the contact members 20 and operative or "on" when the bead liquid 31 does not bridge the gap, since it is the difference in resistivity value that determines the operational status.

Figure 3:
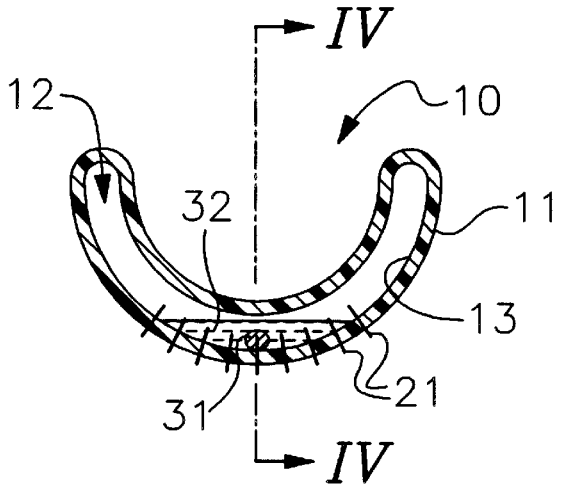
FIG. 3 is a longitudinal cross-sectional view of an alternative embodiment of the invention, where the housing is a curved tube and the contacts are paired members which define a sensing pathway.
Figure 4:
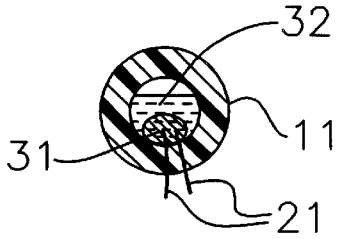
FIG. 4 is a transverse cross-sectional view taken along line IV—IV of FIG. 3.

In FIGS. 3 through 9, the chamber 12 is shown to be curved along the longitudinal axis, as shown in FIG. 3, and circular in transverse cross-section, as shown in FIGS. 4 through 9. The housing 11 may be a curved tube sealed at both ends, with the contact members 20 disposed into or within the chamber 12 to define a sensing pathway which extends in at least two directions within the chamber 12, as opposed to the singular defined contact area shown in FIGS. 1 and 2. The sensing pathway may be linear or curved. In FIGS. 3 and 4, the sensing pathway is comprised of contact members 20 comprising pairs of pins 21. The sensing pathway defines multiple positions where the switch 10 will be in the operative status, since there are multiple attitudes for the housing 11 where the gravity responsive bead liquid 31 will connect the gap between contacts 20. As shown in the embodiment of FIG. 3, the switch 10 will be non-operative if it is tilted too far along its longitudinal axis or if it is rotated too far about its central axis. Alternatively, the operative and non-operative statuses can be reversed.

Figure 5:
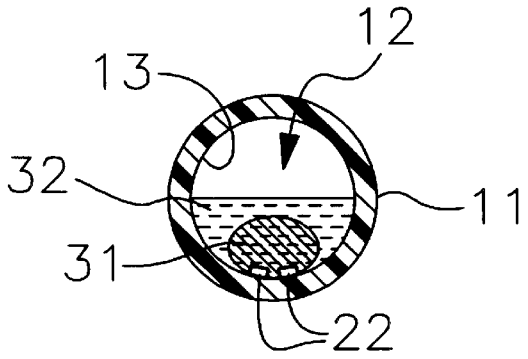
FIG. 5 is a transverse cross-sectional view of an alternative embodiment for the switch of FIG. 3, where the sensing pathway is formed by a pair of strips on the chamber wall, with the switch shown in the operative status.

In an alternative embodiment of FIGS. 5 and 6, the contact members 20 comprise a pair of conductive strips 22 disposed on or partially embedded in the chamber wall 13, which may be foil ribbons, wires or the like, where the strips 22 are separated from each other to define a gap. With the switch 10 in the operative status, as shown in FIG. 5, the bead liquid 31 is disposed on and bridges the gap between the conductive strips 22. When the attitude of the switch 10 is such that the gap is bridged by the carrier liquid 32, as shown in FIG. 6, the switch is non-operative due to the measured difference in resistivity. In an alternative embodiment of FIG. 7, the contact members 20 comprise a pair of conductive wire members 23 which are suspended within the interior of chamber 12 and separated from the chamber wall 13. When the switch 10 is positioned such that the bead liquid 31 connects the two suspended wires 23, the switch 10 is operative. Again, the operative and non-operative statuses can be reversed.

In FIG. 8, an alternative embodiment is shown where one of the contact members 20 comprises a suspended wire 23 disposed within the interior of chamber 12 and the other contact member 20 is the housing 11 itself, where the housing 11 is composed of an electrically conductive material such as metal. In this embodiment the housing 11 and the suspended wire 23 will be connected in the sensing circuit. When the gravity responsive bead liquid 31 contacts the suspended wire 23, the switch 10 is operative. When the switch 10 is rotated or tilted such that the bead liquid 31 does not contact the suspended wire 23, the switch 10 is non-operative. Again, the operative and non-operative statuses can be reversed.

Figure 9:
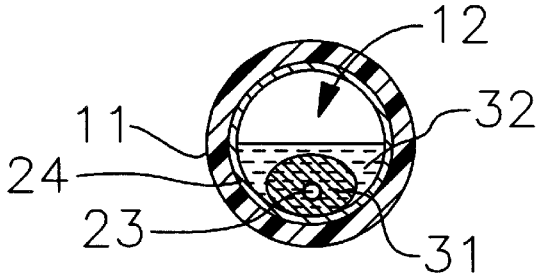
FIG. 9 is a transverse cross-sectional view of an alternative embodiment for the switch of FIG. 8, where the sensing pathway is formed by the combination of a single suspended wire within the chamber and an electrically conductive layer positioned on the chamber wall.

In FIG. 9, an alternative embodiment is shown where one of the contact members 20 comprises a suspended wire 23 disposed within the interior of chamber 12 and the other contact member 20 is a conductive layer 24 disposed onto the wall 13 of chamber 12, where the conductive layer 24 is connected in circuit. The conductive layer 24 may cover the entire chamber wall 13 or may only be deposited on portions of the wall 13. When the gravity responsive bead liquid 31 contacts the suspended wire 23 and the conductive layer 24, the switch 10 is operative. When the switch 10 is rotated or tilted such that the bead liquid 31 does not contact the suspended wire 23 or does not contact the conductive layer 24, the switch 10 is non-operative. Again, the operative and non-operative statuses can be reversed.

Figure 10:
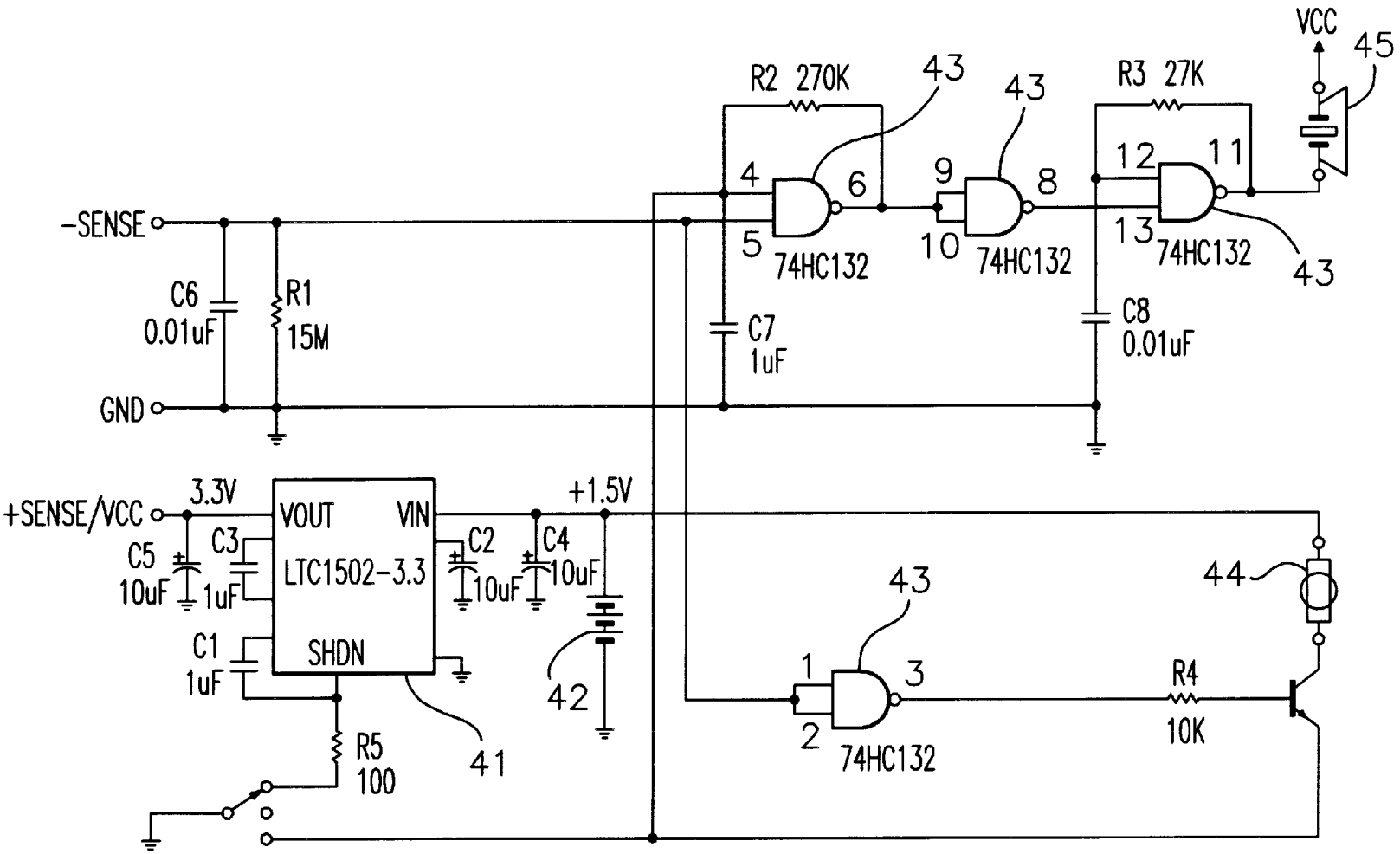
FIG. 10 is a schematic for an electronic circuit which senses the resistivity between the contacts.
Figure 11:
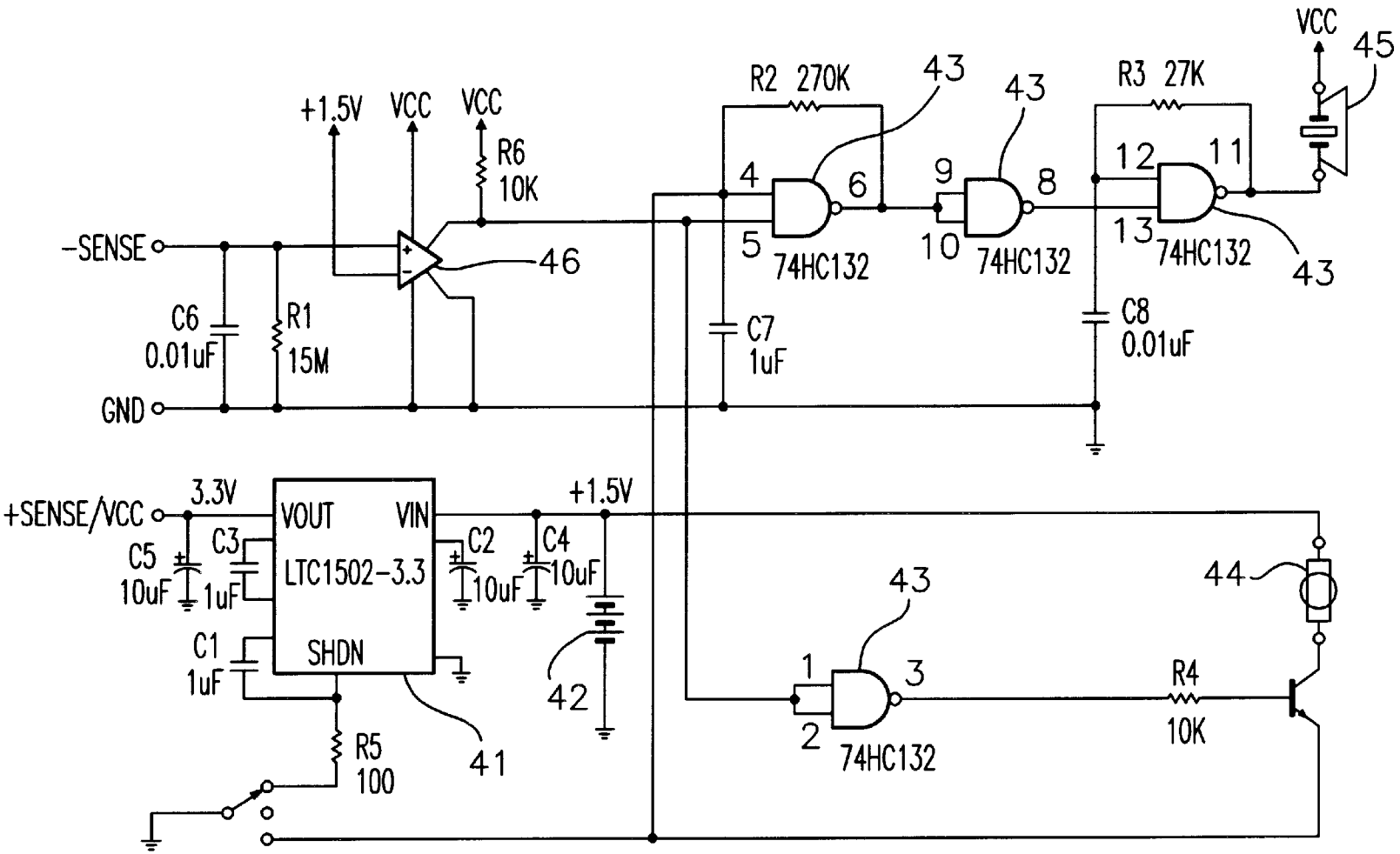
FIG. 11 is a schematic for an alternative electronic circuit which senses the resistivity between the contacts.

The contact members 20 of the switch 10 are connected to a resistivity sensing electronic circuit comprising a means 40 to sense the resistivity value of the circuit containing the contact members 20, whereby the switch 10 actuates an operational electrical circuit to affect a result, e.g., turning an operational element off or on, in response to the change or difference in resistivity value dependent on whether or not the bead liquid 31 is positioned to connect the contact members 20. The resistivity sensing means 40 determines the status of the switch 10 such that the switch 10 is in the first or operational status if the resistivity is at the value resulting from the bead liquid 31 bridging the gap between the contact members 20, and the switch 10 is in the second or non-operative status if the liquid bead 31 is not bridging the gap. Examples of suitable battery powered electronic sensing circuits 40 are shown in FIGS. 10 and 11, where element 41 is a DC to DC power supply chip to step up the voltage from the battery 42, element 43 is a quad nand-gate with Schmitt trigger inputs, and operative elements which as shown consist of a vibratory motor means 44 and an audible signal producing means 45. FIG. 11 further includes a comparator element 46 for sensitivity due to the high impedance of the electronic circuit 40, and is the more preferred version. By providing resistivity sensing means 40, the bead liquid 31 does not have to be an efficient conductor capable of conducting the current without significant loss, since the sensing circuit containing the contact members 20 does not have to provide the operational current for the operative elements. Instead, the difference in the resistivity values between the two liquids 31 and 32 determines the status of the switch 10, with the difference serving as an initiating signal. In the system as shown, bead liquid 31 is more conductive than carrier liquid 32, such that a drop in resistivity occurs whenever the bead liquid 31 connects the gap between the contact members 20. When this drop in resistivity is sensed or measured by the sensing means 40, the switch 10 becomes operative and, for example, closes a circuit such that electricity may flow through an operative electric circuit to operate machinery, etc.

It is understood that equivalents for certain elements set forth above may be obvious to those skilled in the art, and therefore the true scope and definition of the invention is to be as set forth in the following claims.

I claim:

1. A gravity responsive attitude switch having an operative status and an non-operative status, said switch comprising a housing defining a chamber having a wall, electrically conductive contact members disposed within said housing and separated by a gap, said contact members connected in a sensing circuit, a bead liquid and a carrier liquid disposed within said chamber, wherein said bead liquid is immiscible with said carrier liquid, wherein said bead liquid has a different electrical resistivity than said carrier liquid, and whereby said switch may be positioned either in a first status such that said bead liquid connects said contact members or in a second status such that said bead liquid does not connect said contact members;

said switch further comprising means to sense the resistivity in said sensing circuit containing said contact members, wherein the resistivity in said sensing circuit containing said contact members is different when said bead liquid connects said contact members than when said bead liquid does not connect said contact members, and wherein said sensing circuit determines the operative or non-operative status of said switch dependent on the resistivity of said circuit containing said contact members.

2. The switch of claim 1, wherein said bead liquid is denser than said carrier liquid.

3. The switch of claim 1, wherein said bead liquid is disposed in the shape of a bead.

4. The switch of claim 1, wherein said contact members are comprised of electrically conductive pins.

5. The switch of claim 1, wherein said contact members are comprised of multiple pairs of electrically conductive pins defining a sensing pathway.

6. The switch of claim 1, wherein said contact members are comprised of a pair of electrically conductive strips disposed on said chamber wall and defining a sensing pathway.

7. The switch of claim 1, wherein said contact members are comprised of a pair of electrically conductive wires suspended within said chamber and defining a sensing pathway.

8. The switch of claim 1, wherein said contact members are comprised of a single electrically conductive wire suspended within said chamber and said housing, said housing being electrically conductive, and defining a sensing pathway.

9. The switch of claim 1, wherein said contact members are comprised of a single electrically conductive wire suspended within said chamber and an electrically conductive layer disposed on said chamber wall, and defining a sensing pathway.

10. The switch of claim 1, wherein said chamber is a curved tube.

11. The switch of claim 1, wherein said bead liquid has a lower resistivity than said carrier liquid.

12. The switch of claim 1, wherein said bead liquid is chosen from the group of liquids consisting of ethylene glycol, propylene glycol, salt water or silver nitrate, and wherein said carrier liquid is chosen from the group of liquids consisting of silicone oil, benzene or toluene.

13. A gravity responsive attitude switch for opening or closing an operative electric circuit, said switch comprising a housing defining a chamber having a wall, electrically conductive contact members disposed within said housing and separated by a gap, said contact members connected in a sensing circuit whereby the resistance encountered by an electric current passing through said contact members may be sensed, a bead liquid and a carrier liquid disposed within said chamber, wherein said bead liquid is immiscible with said carrier liquid and said bead liquid has a different electrical resistivity than said carrier liquid, and whereby said switch may be positioned either such that said bead liquid connects said contact members or such that said bead liquid does not connect said contact members;

said switch further comprising means to sense the resistivity in said sensing circuit containing said contact members, wherein the resistivity in said sensing circuit containing said contact members is different when said bead liquid connects said contact members than when said bead liquid does not connect said contact members, and wherein said switch opens or closes an operative electric circuit dependent on the sensed resistivity of said circuit containing said contact members.

14. The switch of claim 13, wherein said bead liquid is denser than said carrier liquid.

15. The switch of claim 13, wherein said contact members are comprised of electrically conductive pins.

16. The switch of claim 13, wherein said contact members are comprised of multiple pairs of electrically conductive pins defining a sensing pathway.

17. The switch of claim 13, wherein said bead liquid has a lower resistivity than said carrier liquid.

18. The switch of claim 13, wherein said bead liquid is chosen from the group of liquids consisting of ethylene glycol, propylene glycol, salt water or silver nitrate, and wherein said carrier liquid is chosen from the group of liquids consisting of silicone oil, benzene or toluene.

19. A gravity responsive attitude switch having an operative status and a non-operative status comprising a housing defining a chamber having a wall, electrically conductive contact members disposed within said housing and separated by a gap, means to sense the resistivity encountered by an electric current passing through said contact members, a bead liquid and a carrier liquid disposed within said chamber, wherein said bead liquid is immiscible with said carrier liquid and said bead liquid has a different electrical resistivity than said carrier liquid, and whereby said switch may be positioned either such that said bead liquid connects said contact members or such that said bead liquid does not connect said contact members, wherein the operative status and non-operative status of said switch is determined by the sensed resistivity.

20. The switch of claim 19, wherein said bead liquid is denser than said carrier liquid.

* * * * *